US005111944A

United States Patent [19]

Ostermeyer

[11] Patent Number: 5,111,944

[45] Date of Patent: May 12, 1992

[54] CONTAINER STATION

[76] Inventor: Walter H. Ostermeyer, 2415 Forest Park Blvd., Fort Wayne, Ind. 46805

[21] Appl. No.: 529,439

[22] Filed: May 29, 1990

[51] Int. Cl.[5] ..... A47F 7/00

[52] U.S. Cl. ..... 211/133; 211/126

[58] Field of Search ..... 211/133, 126, 128

[56] References Cited

U.S. PATENT DOCUMENTS

| | | | |
|---|---|---|---|
| D. 162,990 | 4/1951 | Roeder . | |
| 1,300,975 | 4/1919 | Jones . | |
| 1,612,903 | 1/1927 | Bitney | 211/133 X |
| 1,733,406 | 10/1929 | Goulet . | |
| 2,108,122 | 2/1938 | Hall . | |
| 2,850,170 | 9/1958 | Palmer . | |
| 2,926,022 | 2/1960 | Nau et al. | 211/133 X |
| 3,894,634 | 7/1975 | Gotham et al. | 211/150 |
| 4,403,701 | 9/1983 | Corcoran | 211/133 |
| 4,666,201 | 5/1987 | Chap . | |
| 4,771,900 | 9/1988 | Leoncavallo . | |
| 4,821,893 | 4/1989 | Wyatt . | |
| 4,887,538 | 12/1989 | Arnold . | |

FOREIGN PATENT DOCUMENTS

| | | | |
|---|---|---|---|
| 1296100 | 5/1962 | France | 211/133 |
| 1135058 | 11/1968 | United Kingdom | 211/133 |

*Primary Examiner*—David M. Purol
*Assistant Examiner*—Sarah A. Lechok
*Attorney, Agent, or Firm*—Lundy & Associates

[57] ABSTRACT

A container station, which has a plurality of cornerposts retained in spaced relation. A plurality of cradles extend between opposed pairs of cornerposts. Each cradle has front and rear support members. A plurality of primary containers depend from the cradles. Each primary container has a brim and a bottom. Each primary container is movable between a rest position and an access position. The brim overlies and is supported by a respective front support member in its rest position. The brim is disposed below and unsupported by a respective front support member in its access position. The bottom is continuously supported by a respective rear support member during movement between rest and access positions.

23 Claims, 2 Drawing Sheets

CONTAINER STATION

BACKGROUND OF THE INVENTION

The present invention pertains to storage structures and more particularly pertains to a container station.

Many types of items, such as recyclables and laundry, need to be sorted, a few items at a time, for storage until disposition. Containers and horizontal shelving provide storage at the expense of easy access and unobstructed vision of the contents of the containers. Attempts to increase physical or visual access may be at the expense of storage efficiency and may make removal of full containers difficult.

It is therefore highly desirable to provide an improved container station.

It is also highly desirable to provide an improved container station which provides easy physical and visual access to containers.

It is also highly desirable to provide an improved container station from which full containers are easily removable.

It is also highly desirable to provided an improved container station which can be easily expandable to hold more or less containers, as desired.

It is also highly desirable to provide an improved container station which provides efficient storage.

It is finally highly desirable to provide an improved container station which meets all of the above desired features.

SUMMARY OF THE INVENTION

It is an object of the invention to provide an improved container station.

It is another object of the invention to provide an improved container station which provides easy physical and visual access to containers.

It is another object of the invention to provide an improved container station from which full containers are easily removable.

It is another object of the invention to provide an improved container station which provides efficient storage.

It is another object of the invention to provide an improved container station which can be easily expandable to hold more or less containers, as desired.

It is finally an object of the invention to provide an improved container station which provides all of the above objects.

In the broader aspects of the invention there is provided a container station, which has a plurality of cornerposts retained in spaced relation. A plurality of cradles extend between opposed pairs of cornerposts. Each cradle has front and rear support members. A plurality of primary containers depend from the cradles. Each primary container has a brim and a bottom. Each primary container is movable between a rest position and an access position. The brim overlies and is supported by a respective front support member in its rest position. The brim is disposed below and unsupported by a respective front support member in its access position. The bottom is continuously supported by a respective rear support member during movement between rest and access positions.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
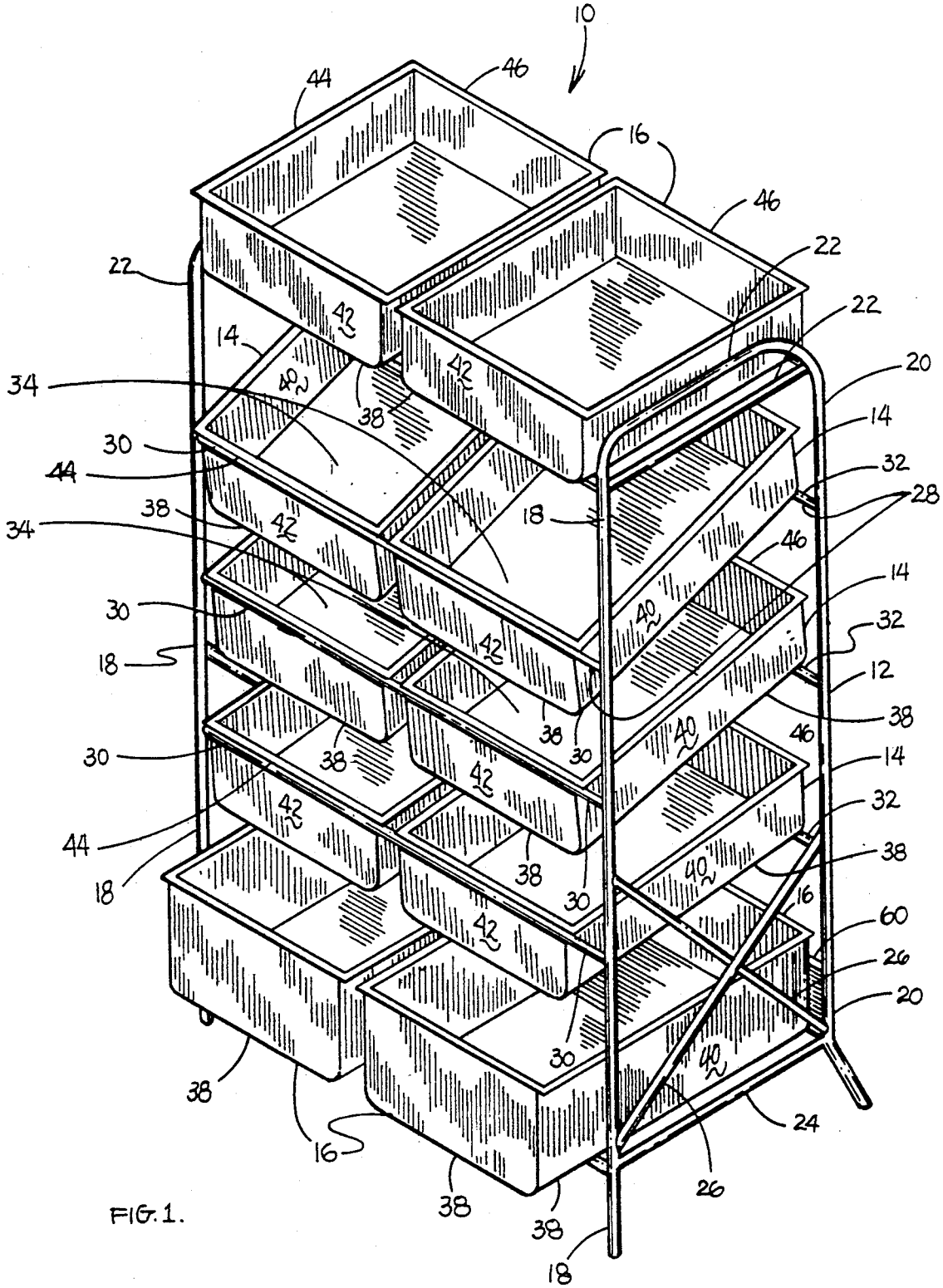
FIG. 1 is a perspective view of an embodiment of the container station of the invention.

The container station 10 of the invention includes a rack 12 and containers 14, 16. Rack 12 has a pair of front cornerposts 18 and a pair of rear cornerposts 20, all of which are narrow and elongate. Joined to the top and bottom of each cornerpost are upper 22 and lower horizontal members 24. In order to increase the rigidity of rack 12, braces 26 may be attached to adjoining front and rear cornerposts 18, 20 adjacent to horizontal members 22, 24 and between rear cornerposts 20 as needed.

A series of vertically spaced apart cradles 28 are located between horizontal members 22, 24. Each cradle 28 has a front support member 30 and a rear support member 32. and extends between front cornerposts 18 and rear cornerposts 20, respectively. Each support member 30, 32 is bar shaped and is mounted to the inside or outside of respective cornerposts 18, 20. Each cradle 28 defines either a single primary container space 34 or two or more primary container spaces 34 disposed side by side. In a preferred embodiment of the invention, each cradle 28 is limited to a front support member 30 and an adjoining rear support member 32.

In specific embodiments, the container station 10 has at least one container space 34 side by side and one, two or three container spaces stacked vertically to provide two, four or six container spaces 34 and container station 10 having three to multiples of five containers for each station 10, as desired.

Each primary container 14, in a rest position 36, occupies a primary container space 34. Primary containers 14 are each shaped roughly like a rectangular box, having a bottom 38 joined to four walls 40, 42, and 46. Bottom 38 and side walls 40, front wall 42, and rear wall 46 may be solid or perforated, as desired. Surmounting at least front wall 42 is a brim 44, which extends outward. Each primary container 14 depends from the front and rear support members 30, 32 of a respective cradle 28. Brim 44 engages front support member 30 and bottom 38 engages rear support member 32. Bottom 38 is sufficiently smooth so as to be able to pivot and slide on rear support member 32, which may be rounded or otherwise adapted for the same purpose.

Support members 30, 32 of each cradle 28 are arranged so as to decline primary containers 14 relative to horizontal members 22, 24. In order to prevent items (not shown) from falling out of primary containers 14, the decline should be less than 45 degrees, or, more desirably, between about 10 and about 30 degrees from the horizontal. It is also desirable to increase the decline by stages from the lowest to the highest primary container 14. In a particular embodiment of the invention, primary containers 14 decline from horizontal, from the lowest to the highest containers, at angles of about 12, 24 and 27 degrees, respectively.

Figure 2:
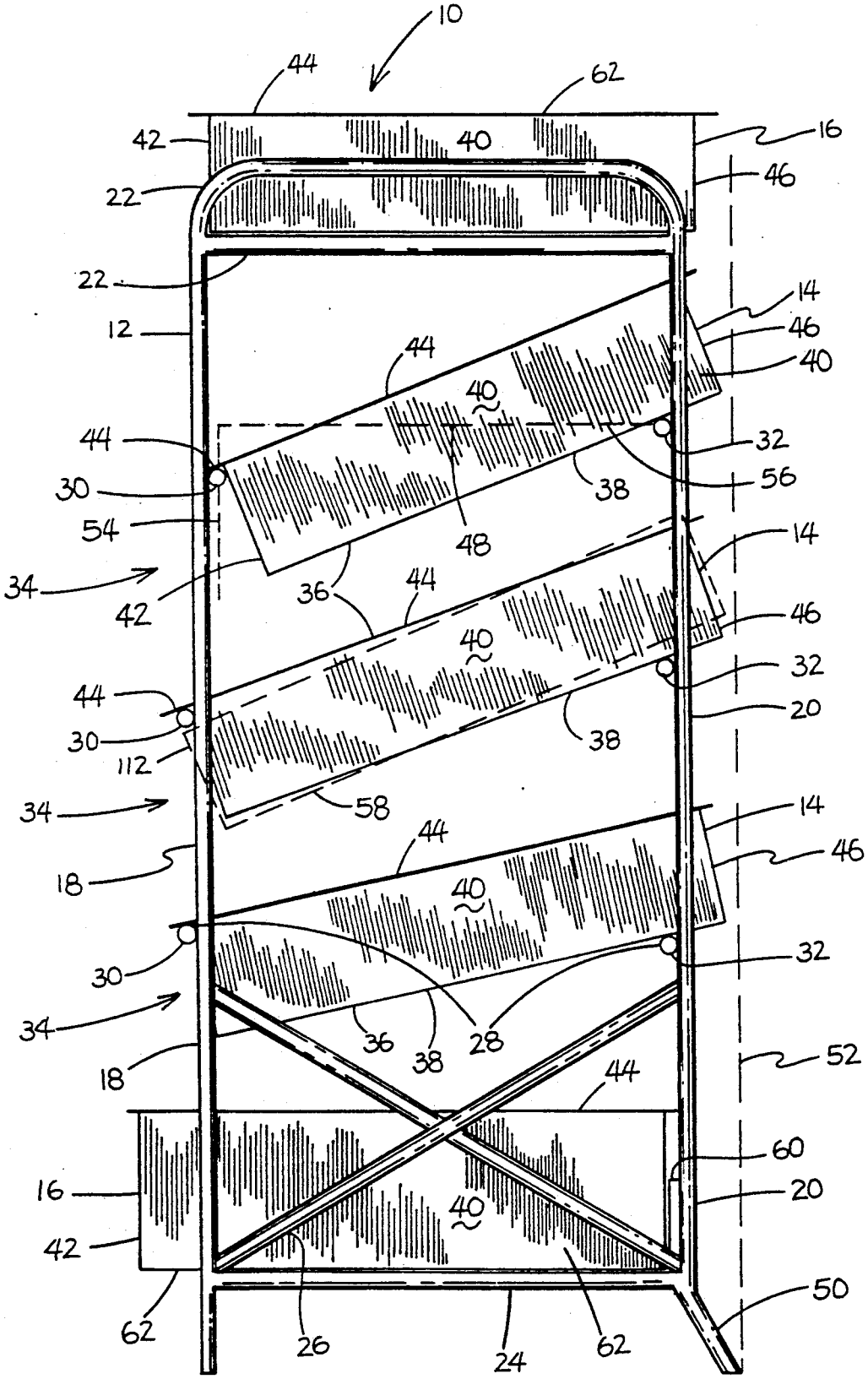
FIG. 2 is a side plan view of the container station of FIG. 1. Primary containers are shown in rest position in solid lines. A middle primary container is shown in access position in dashed lines. Dashed lines also indicate the horizontal separation of front and rear support members and the vertical dimension, along the front support member of a primary container space defined by the upper cradle. The rearmost extent of the container station is indicated by a dashed vertical line.

The length of primary containers 14 from front wall 42 to back wall 46 is desirably equal to or greater than the horizontal separation of front and rear support members 30, 32 (indicated in FIG. 2 by dashed line 48). The decline of primary containers 14 causes them to extend rearwardly of rear support members 32. In a particular embodiment of the invention, rear cornerposts 20 have a rearwardly canted lower section 50, which has a rearward extension greater than that of primary containers 14 (indicated in FIG. 2 by dashed line 52). This allows placement of rack 12 against a wall and allowing an additional rear clearance for the rearward extension of primary containers 14.

The inclines of primary containers 14 are dependent on the relative vertical positioning of front and rear support members 30, 32 of each cradle 28; the horizontal separation of front and rear support members 30, 32; and the height, that is, the separation of bottom 38 and brim 44, of primary containers 14. These parameters also determine a minimum front vertical dimension for each primary container space 34. The vertical dimension of a primary container space, extending downwardly from the front support member 30 of the cradle 28 (indicated in FIG. 2 by dashed line 54), is greater than the sum of the vertical separation of front and rear support members 30, 32 of the cradle 28 plus the product of the horizontal separation of front and rear support members 30, 32 multiplied by the tangent of the angle 56 of decline from horizontal of the primary container 14 supported by the cradle 28.

In a particular embodiment of the invention, each cradle 28 has a front support member 30 disposed vertically higher than the rear support member 32 of that cradle 28, by a distance less than vertical separation of brim 44 and bottom 38 of a respective primary container 14. In an example of that embodiment, container station 10 has three cradles 28, each of which holds two primary containers 14. Each primary container 14 has a height of 10.75 inches. The horizontal separation of front and rear support members 30, 32 is 17.0 inches. The length of primary containers 14 in a direction from front wall 42 to back wall 46 is 22.5 inches. The vertical separations of front and rear support members 30, 32 of each cradle 28 are: 3.0 inches, 3.5 inches and 7.0 inches, in order, from the top, respectively. The vertical separations of cradles 28, from rear support member 32 of the upper cradle 28 to front support member 30 of the lower cradle 28 are: 12.25 inches and 11 inches, in order, from the top, respectively. Primary container spaces 34 have vertical dimensions, downwardly from respective front support members 30, of about 9.3 inches, 15.0 inches and 13.5 inches, in order from the top, respectively.

Referring now particularly to the middle cradle illustrated in FIG. 2, primary containers 14 are freely movable between rest position 36 and an access position 58. In rest position 36, brim 44 overlies and is supported by a respective front support member 30. In access position 58, brim 44 underlies and is not supported by the front support member 30. Bottom 38 is supported by rear support member 32, in rest position 36, in access position 58 and in moving between the two positions. Containers 14 are removable from their respective cradles 28 when in their access position 58 by merely sliding the containers 14 forwardly.

In a particular embodiment of the invention, horizontal members 22, 24 are flat shelves and secondary containers 16 are disposed on upper and lower horizontal members 22, 24. Lower horizontal member 24 includes a stop 60, which may take the form of an upwardly extending flange. Stop 60 precludes rearward travel of lower secondary containers 16 out of a stowed position 62 in which lower secondary containers 16 rest on lower horizontal member 24 and abut stop 60. In stowed position 62, secondary containers 16 extend forward beyond front cornerposts 18 and beyond primary containers 14.

In use, primary containers 14 and secondary containers 16 on lower horizontal member 24 may be filled as needed without movement from rest and stowed positions 36, 58, respectively, due to the inclines of primary containers 14 and the relatively forward location of lower secondary members 16. Upper secondary containers 16 on upper horizontal member 22 may have to be moved for loading due to their horizontal orientation and high position. After loading, secondary containers 16 are removed for emptying by simply lifting and forward movement. Primary containers 14 are removed for emptying after loading, by first lifting container 14 slightly to reduce or eliminate the frictional engagement of brim 44 and front support member 30, then pushing container 14 backwards until brim 44 is behind front support member 30, then pivoting container 14 until brim 44 is below front support member 30, and then pulling container 14 forward and providing vertical support after bottom 38 clears rear support member 32. This process is reversed to return primary container 14 to cradle 28.

The improved container station of the invention provides easy access to the containers and allows full containers to be easily removed for emptying. Used for both recyclables and laundry, the improved container station stores the containers efficiently and has all of the above features.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto.

What is claimed is:

1. A container station comprising a plurality of cornerposts, means for retaining said cornerposts in spaced relation, a plurality of cradles extending between opposed pairs of said cornerposts, each said cradle having a front support member and a rear support member, and a plurality of primary containers depending from said cradles, respectively, each said primary container having a front and rear brim and a bottom, each said primary container being movable between a rest position and an access position, said front brim overlying and being supported by a respective one of said front support members in said rest position, said front brim being disposed below and being unsupported by a respective one of said front support members in said access position, said bottom being continuously supported by a respective one of said rear support members adjacent to said rear brim during movement between said rest position and said access position.

2. The container station of claim 1 wherein said primary containers are declined in said rest position.

3. The container station of claim 1 further comprising a lower horizontal member joined to said cornerposts below said cradles, and at least one secondary container disposed on said lower horizontal member, each said secondary containers extending forward of said cornerposts.

4. The container station of claim 1 wherein each of said cradles define a primary container space having a vertical dimension extending downwardly from the respective one of said front support members of said cradle, greater than the sum of the vertical separation of the respective one of said front and rear support members of said cradle plus the product of the horizontal separation of the respective one's said front and rear support members multiplied by the tangent of the angle of decline from horizontal of the respective one of said primary containers supported by each of said cradles.

5. The container station of claim 1 wherein each said cradle has respective ones of said front and rear support members vertically and horizontally separated.

6. The container station of claim 5 wherein said separations are sufficient to slant said primary containers, in said rest position, downwardly at an angle of between 0 and 45 degrees with the horizontal.

7. The container station of claim 5 wherein said separations are sufficient to slant said primary containers in said rest positions downwardly at an angle with the horizontal of between 10 and 30 degrees.

8. A container station comprising a pair of spaced apart, horizontal members, front and rear pairs of cornerposts joined to each of said horizontal members, a plurality of cradles disposed between said horizontal members, each said cradle having a front support member and a rear support member joined to front and rear cornerposts, respectively, and a plurality of primary containers depending from said cradles, each of said primary containers having a front and rear brim and a bottom, said front brims engaging a respective one of said front support members, said bottoms engaging a respective one of said rear support members adjacent said rear brims.

9. The container station of claim 8 wherein said primary containers are inclined relative to said horizontal members.

10. The container station of claim 8 wherein each said cradle has a respective one of said front support members disposed vertically higher than a respective one of said rear support members.

11. The container station of claim 10 wherein the vertical separation of respective said forward and rear support members is less than the vertical separation of said brims and said bottoms of said primary containers.

12. The container station of claim 10 wherein the vertical separation of respective said forward and rear support members decreases by stages from the lowest of said cradles to the highest of said cradles.

13. A container station comprising spaced apart, upper and lower horizontal members, a pair of front cornerposts joined to each of said horizontal members, a pair of rear cornerposts joined to each of said horizontal members, a plurality of front support members joined to said front cornerposts between said horizontal members, a plurality of rear support members joined to said rear cornerposts between said horizontal members, each said front support member and an adjoining said rear support member defining a cradle, and a plurality of primary containers depending from said cradles, each of said primary containers having a front and rear brim and a bottom, said front brims engaging a respective one of said front support members, said bottoms engaging a respective one of said rear support members adjacent said rear brims.

14. The container station of claim 13 wherein said rear support members are vertically offset from said front support members.

15. The container station of claim 13 wherein said bottoms are pivotable and slideable on said rear support members.

16. The container station of claim 13 further comprising a stop disposed at the rear of said lower horizontal member and at least one secondary container disposed on said lower horizontal member, each said secondary container abutting said stop and having a greater forward extension relative to said lower horizontal member than said primary containers.

17. The container station of claim 16 wherein each said primary container is movable between a rest position and an access position, said brims in said rest position overlying and being supported by a respective one of said front support members, said brims in said access position being disposed below and being unsupported by said front support members, said bottoms in said rest position and in said access position being supported by a respective one of said rear support members.

18. The container station of claim 17 wherein said bottoms are supported by said rear support members during movement between said rest and access positions.

19. The container station of claim 18 wherein said primary containers extend rearwardly of said horizontal members, and said rear cornerposts are rearwardly canted to a horizontal distance greater than the rearward extension of said primary containers.

20. The container station of claim 19 wherein at least two said primary containers depend from each of said cradles.

21. The container station of claim 1 wherein the higher ones of said front support members are connected to said cornerposts inwardly thereof and the lower ones of said front support members are connected to said cornerposts inwardly thereof.

22. The container station of claim 8 wherein the higher ones of said front support members are connected to said front cornerposts inwardly thereof and the lower ones of said front support members are connected to said front cornerposts outwardly thereof.

23. The container station of claim 13 wherein the higher ones of said front support members are connected to said front cornerposts inwardly thereof and the lower ones of said front support members are connected to said front cornerposts outwardly thereof.

* * * * *